US005311237A

United States Patent [19]

Kawada et al.

[11] Patent Number: 5,311,237

[45] Date of Patent: May 10, 1994

[54] FILM CONTAINER AND AUTOMATIC DEVELOPING APPARATUS

[75] Inventors: Ken Kawada; Tadashi Tanaka, both of Kanagawa, Japan

[73] Assignee: Fuji Photo Film Co., Ltd., Kanagawa, Japan

[21] Appl. No.: 889,433

[22] Filed: May 28, 1992

[30] Foreign Application Priority Data

May 28, 1991 [JP] Japan ..... 3-150896
Mar. 12, 1992 [JP] Japan ..... 4-87552

[51] Int. Cl.[5] ..... G03D 13/14
[52] U.S. Cl. ..... 354/341
[58] Field of Search ..... 354/319, 320, 340, 341; 414/403; 355/72, 75

[56] References Cited

U.S. PATENT DOCUMENTS 3,568,587 3/1971 Laval ..... 354/310
4,253,788 3/1981 Oaks et al. ..... 414/403

FOREIGN PATENT DOCUMENTS 0349448 6/1989 European Pat. Off. .
2545215 4/1977 Fed. Rep. of Germany ..... 354/319
61-151654 7/1986 Japan ..... 354/319

*Primary Examiner*—D. Rutledge
*Attorney, Agent, or Firm*—Sughure, Mion, Zinn, Macpeak & Seas

[57] ABSTRACT

An automatic developing apparatus which can supply a photographic film without use of a leader. The automatic developing apparatus 100 has an automatic loader 31 in which a plurality of film containers 1 are held in a holder 32, a feed-out control mechanism 33 and a shutter mechanism 35 to individually and successively position the containers 11 in a film draw-out position, a film draw-out mechanism for withdrawing the film 1 in the condition that the curling of the film 1 is prevented, and a developing tank for developing the film. According to another embodiment of the invention, in the case where the container 1 is not used, after the cartridge 2 has been supplied into the film draw-out position, positioning of the cartridge 2 is performed by rotating the cartridge 2 so that the draw-out portion of the cartridge 2 is correctly oriented.

8 Claims, 9 Drawing Sheets

FILM CONTAINER AND AUTOMATIC DEVELOPING APPARATUS

BACKGROUND OF THE INVENTION

1. Field of the Invention

The present invention relates to a film container adapted for automatically developing a photographic film which does not have a leader attached thereto, and an automatic developing apparatus adapted for developing the photographic film.

2. Background Art

A conventional photographic film 1 is rolled in a cylindrical cartridge 2 as shown in FIG. 15 allowing the end of the film to be withdrawn from the cartridge substantially tangentially thereto. Since the film 1 is wound around a core in the cartridge 2, the film 1 has a curled shape, as illustrated, after it has been withdrawn from the cartridge.

On the other hand, in a developing apparatus for developing the film 1, the film 1 is carried while successively submerged in a series of treatment solutions. As shown in FIG. 16, the film 1 is intended to be positioned between a draw-out roller 4, rotationally driven in the direction of the arrow by a driving system 3, and a nip roller 5, so that the film 1 can be conveyed to a developing tank (not shown).

However, the curl of the film 1 often prevents the end of the film 1 from being properly positioned between the draw-out roller 4 and the nip roller 5, as shown by the solid line in FIG. 8. As a result, the film 1 cannot be properly conveyed or otherwise may become jammed.

To prevent the aforementioned problem, the curling of the film 1 may be corrected by removing the film in a manner that causes the film to curl in the opposite direction to its natural curl or by attaching an uncurled leader to the film. However, the decurling of the film must be performed in a dark room to avoid exposure of the film to light resulting in attendant disadvantages. Further, the attaching of the leader must be performed by hand, so that not only preparation of the leader is required but much labor is required for attaching the leader.

Although a method of automatically supplying the film 1 to the developing apparatus in the condition that a leader is attached to the end of the film 1 has been proposed (see Unexamined Japanese Patent Application (OPI) Nos. Hei-3-12305 and Hei-3-12306), an apparatus for automatically supplying and processing the film 1 without use of any leader has not been devised.

The present invention is designed to overcome these problems. Specifically, an object is to provide a film container adapted for automatically supplying a film to a draw-out position, and also to provide an automatic developing apparatus arranged to efficiently perform a series of development treatments by automatically supplying films to the developing apparatus.

SUMMARY OF THE INVENTION

The above object of the present invention is attained by the following features.

According to a first embodiment, a film container is provided which includes a storage portion for storing a cartridge containing a roll of film while controlling the direction of an outlet of the cartridge, and a film leading-out portion for supporting an end portion of the film drawn out from the outlet to correct the curling of the end portion of the film.

According to another embodiment of the invention, an automatic developing apparatus is provided which includes a holder for holding a predetermined number of containers storing the film cartridges, a conveying control mechanism for holding the containers in the holder and for individually and successively feeding out the containers, a shutter mechanism for shading a film draw-out position at all times except during the feed-out of the container, a draw-out mechanism for withdrawing the film out of the container positioned in the film draw-out position, and an ejecting mechanism for ejecting the container from the draw-out position. The holder and the container each have engagement portions which are fitted to each other only when the container is loaded in a proper direction.

According to yet another embodiment of the invention, an automatic developing apparatus includes a holder for holding a desired number of cartridges each containing a roll of photographic film, a feed control mechanism for individually and successively feeding the cartridges to a film draw-out position, a mechanism for adjusting the angular orientation of the cartridge by rotating the cartridge in the draw-out position, a shutter mechanism for shading the draw-out position at all times except during the feed-out of the cartridge, a draw-out mechanism for withdrawing the film from the cartridge positioned in the film draw-out position, and an ejecting mechanism for ejecting the cartridge from the draw-out position.

The holder holds the cartridges adjacent one another along a slide, and the feed-out control mechanism includes a pair of coaxially disposed arms, one of the arms supporting the lowermost cartridge and being rotatable to feed the lowermost cartridge and the other arm acting to block the adjacent cartridge upon rotation of the first arm. Further, the holder has a preferential treatment gate for guiding another cartridge not being held in the holder into the film draw-out position prior to the cartridges being held in the holder.

Still further, a film end treatment device is provided for pulling the film out of the cartridge and for cutting the film to a desired length.

Still further, the developing apparatus includes a section for developing a leader-less photographic film (having no leader attached to its end), and a section for developing a photographic film having a leader attached thereto in a side by side relationship.

The container is designed to prevent the end of the film from curling so that the film will not interfere with the conveyance of the film along the holder.

The carrying and positioning of the film container to the film draw-out position and the withdrawing of the film are performed automatically, so that automatic developing can be made speedily and steadily.

When the container is stored in the holder of the automatic developing apparatus, it is necessary to store the container so that the film outlet of the cartridge is oriented in a proper direction. Therefore, engagement portions which are fitted to each other only when the holder is loaded with the container in the proper direction are respectively provided on the holder and the container to thereby prevent the incorrect loading of the container in the holder the container.

Even in the case where the above container is not used, the automatic developing apparatus has a mechanism for rotating the cartridge so that it is disposed in the proper orientation in the draw-out position to make it possible to automatically withdraw the film from the cartridge. Specifically, the film partially withdrawn from the cartridge can be brought into the carrying means properly by rotating the cartridge in the proper direction after sliding the leader-less film down from the holder. As a result, the film can be carried properly.

Examples of the film carrying means used herein are nip roller, sprocket, belt, etc. The end portion of the film drawn out of the cartridge can be related to these carrying means by turning the film outlet of the cartridge so as to oppose the carrying means. With respect to the rotation of the cartridge, the cartridge can be rotated by urging against the film slightly protruding from the cartridge so as to rotate the cartridge to a proper position, that is, to a position where the end of the film is in contact with the carrying means. To move the film as described above, a pair of nip rollers for pulling out the film may be provided so that one of the nip rollers can serve as a movable roller moving toward the other nip roller while retaining the film therebetween.

With respect to automatic supply of the leader-less film, the film cannot be brought into contact with the carrying means properly if the end of the film is not extended by a predetermined length from the cartridge. In order to carry the film without use of any leader, it is preferable that the tongue portion at the end portion of the film be cut off at a right angle. In general, a tongue draw-out device is used for pulling the film out of the cartridge. The film end treatment work can be carried out very easily and smoothly by providing the tongue draw-out device in the inside of the apparatus in the vicinity of the holder and further providing an end treatment mechanism for cutting the end of the film in the tongue draw-out device.

To supply the cartridges stored in the containers one by one to the film draw-out portion when occasion arises, for example, the holder may be provided obliquely so that the cartridges are arrange adjacent one another. The one-by-one supply of the cartridges is performed by suitably releasing the supporting of the lowermost cartridge. When the supporting of the lowermost is released, the upper cartridges need to be supported so as not to slide down. Using the aforementioned feed-out control mechanism, the operation of releasing the lowermost cartridge and the operation of supporting the upper cartridges can be carried out simultaneously.

The cartridges are supplied to the film draw-out portion in order starting from the lowermost cartridge. When there is any film to be preferentially treated, the treatment order needs to be changed to allow introduction of the preferred film. Therefore, at least one portion of the holder above the inclined surface thereof, or more preferably, a portion of the holder below the lower most cartridge, may be formed in an open state or in an openable state. When, for example, the holder is U-shaped in section, the cartridge having the preferential film can be placed in any suitable position. Further, a different loading inlet serving as a preferential treatment gate may be formed in the holder.

In the aforementioned automatic developing apparatus, the cartridges can be supplied automatically without use of any leader. Accordingly, the conventional work for attaching a leader to each film can be omitted, so that the developing work can be simplified. The leader-less films are drawn out of the cartridges and successively carried into the respective tanks and submerged in treatment solutions, so that the leader-less films are successively treated. Because the leader-less film is slightly curled at its end, the film must be guided by guide members and the like properly so as not to diverge from the carrier path. The leader-less film can be carried more surely by forming the carrier path like a slit in addition to the carrying means including nip rollers or the like. If the yet untreated leader-less film is wet or if the perforations are in poor condition, it is possible that the film may not be properly conveyed. In such a case, a leader may be attached to the end of the film in the same manner as the conventional technique, so that the film can be carried while led by the leader. Therefore, both a section for treating a leader-less film and a section for treating a leader-containing film may be provided in the apparatus. It is to be understood that the meaning of "both" is that the two types of films can be treated, and that the two treatment sections need not always be provided. For example, the configuration may be such that the two types of films may be treated by only one treatment section. On the contrary, in the case where two types of treatment lines are provided, common treatment tanks may be used.

Further, a carrier rack having the carrying means may be used for both treatment lines. Further, a part of a system for driving the carrier rack may be used for both lines. Further, treatment tanks and carrier racks may be provided separately with respect to the respective treatment lines. In this case, a partition wall between the tank in one treatment line and the tank in the other treatment line may be formed so as to be able to be opened. When occasion arises, a part of the partition wall may be opened to mix treatment solutions of the same kind in the two lines so that they are of the same strength or the like.

By providing the two sections for respectively treating a leader-less film and a leader-containing film, films, such as 135-size films, 110-size films, brownie size films, etc., can be treated by one automatic developing apparatus. For example, 135-size leader-less films can be treated by one treatment section, and brownie size films each having a leader attached thereto can be treated by the other treatment section.

DETAILED DESCRIPTION OF THE PREFERRED EMBODIMENTS

Figure 1:
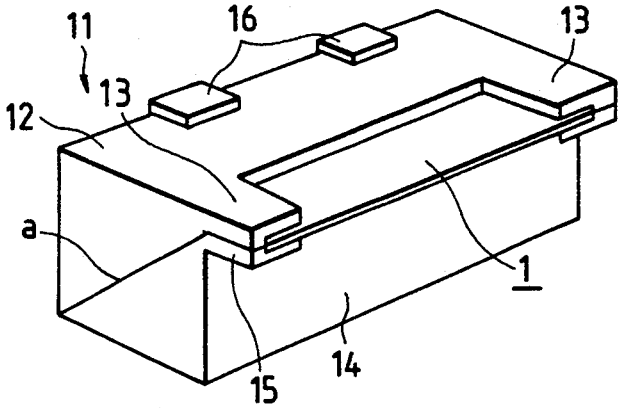
FIG. 1 is a perspective view of a film container according to an embodiment of the present invention.
Figure 2:
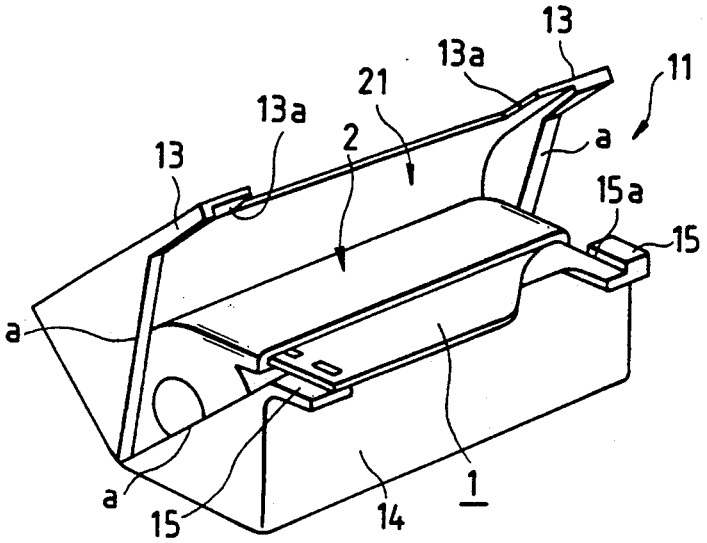
FIG. 2 is a perspective view of the film container in an opened state.
Figure 3:
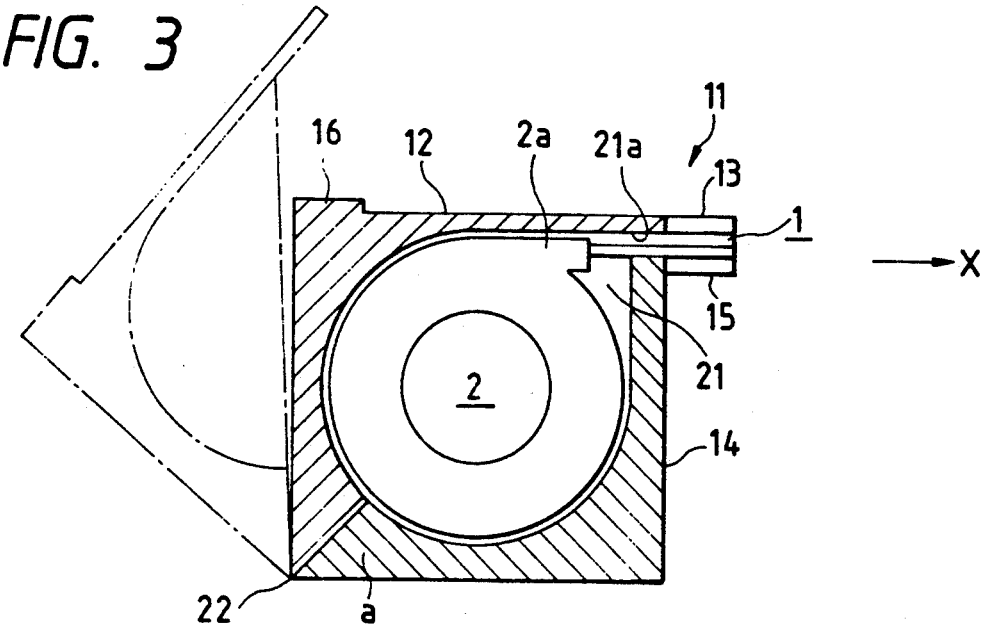
FIG. 3 is a sectional view of the film container according to the invention.
Figure 4:
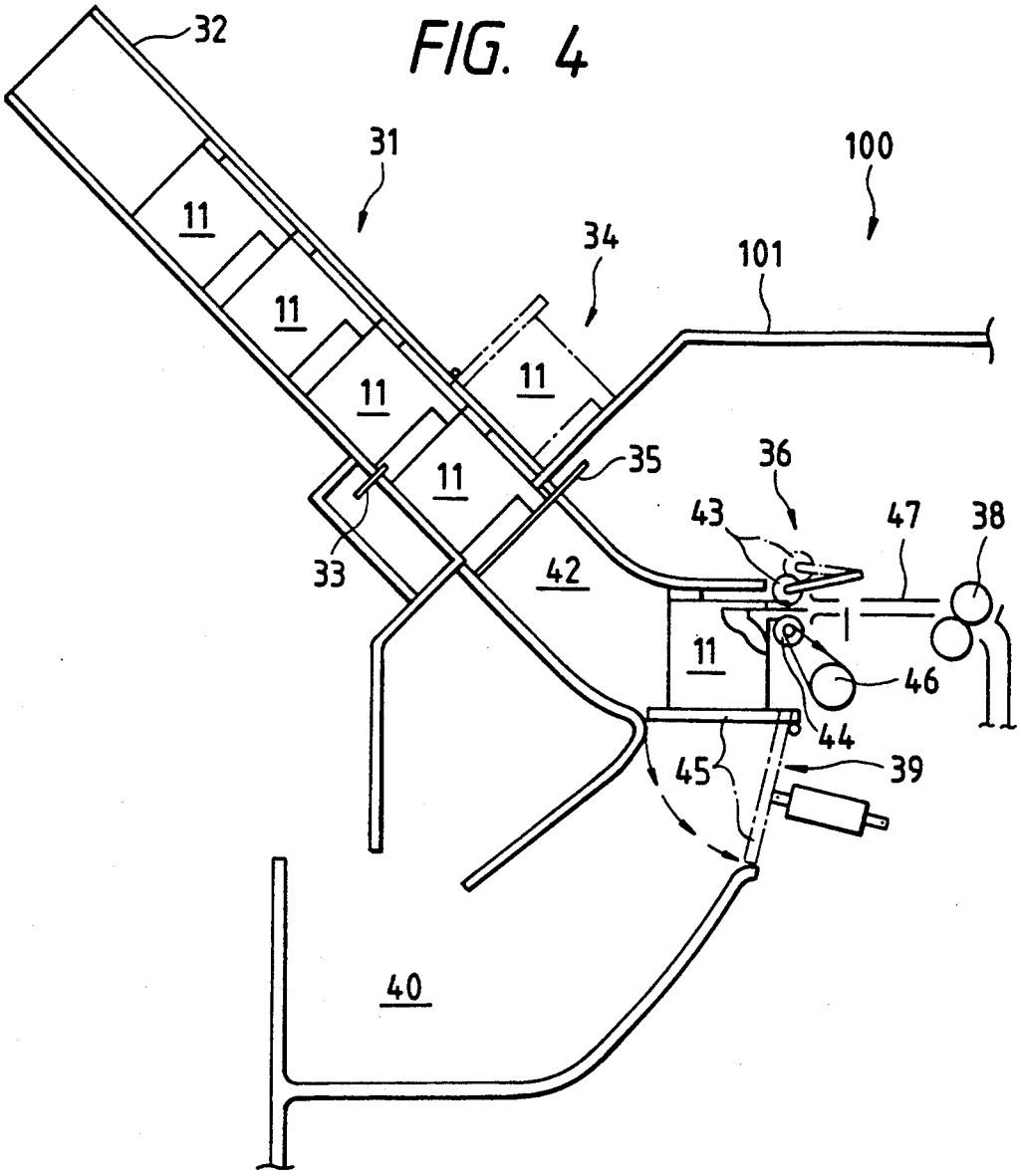
FIG. 4 is a configuration diagram of an automatic loader according to the invention.
Figure 5:
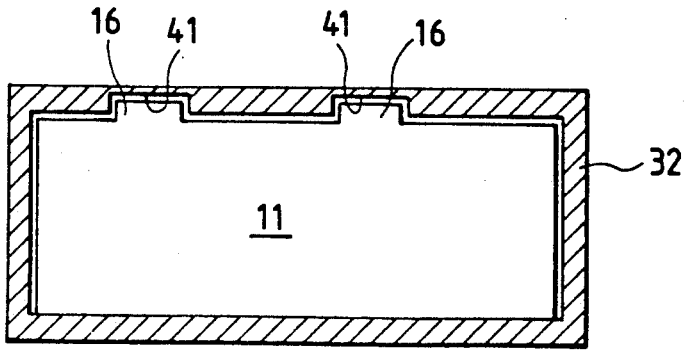
FIG. 5 is a cross-sectional view of the holder according to the invention.
Figure 6:
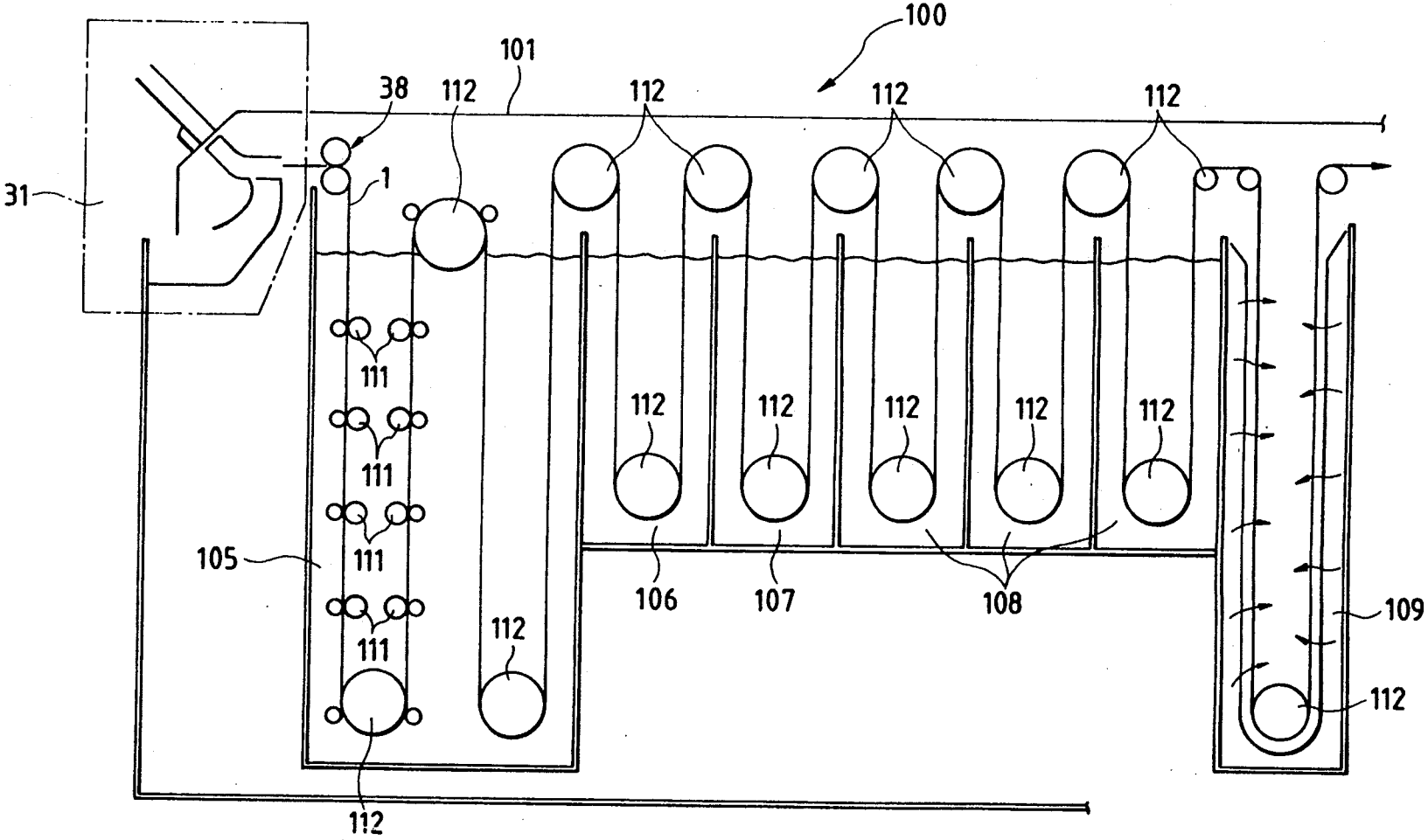
FIG. 6 is a configuration diagram of an automatic developing apparatus according to the present invention.

A first embodiment of the present invention will be described hereunder with reference to FIGS. 1 through 6. Figs. 1 through 3 show an example of the film container according to the present invention. FIGS. 4 through 6 show the configuration of an example of the automatic developing apparatus using the film cartridge. In the following description of the embodiments, the film container and the automatic developing apparatus will be described successively.

With respect to the external appearance of the film container 11, the container is substantially shaped like a rectangular parallelepiped and includes two pivotally attached half portions which can be opened along diagonally extending line a.

A pair of guide portions 13 are respectively provided so as to extend from opposite end portions of an upper face 12 and a pair of guide portions 15, opposite to the pair of guide portions 13, are further provided in opposite end portions of a front face 14 perpendicular to the upper face 12. Additionally, a pair of guide projections 16 are provided on the upper face 12 opposite the pair of guide portions 13. As explained below, the guide projections 16 serve as guides for supplying the container 11 to the automatic developing apparatus.

The inside of the container 11 includes a substantially cylindrical storage portion 21. The container 11 is arranged so as to be opened and closed by pivoting one half of the container with respect to the other half about hinge 22, as shown in FIGS. 2 and 3. When the container is opened, a half of the storage portion 21 is accessible, as shown in FIG. 2 making it easy to store the cartridge 2 in the container.

As illustrated in FIG. 2, step portions 13*a* are formed in lower surfaces of the pair of guide portions 13 and corresponding step portions 15*a* are further formed in upper surfaces of the pair of guide portions 15. When the container 11 is shut as shown in FIG. 1, slits are formed by the step portions 13*a* and 15*a* to guide the opposite lateral side portions of the film. These slits correspond to a film leading-out portion defined in the present invention.

When the cartridge 2 is to be stored in the container 11 having the aforementioned structure, the cartridge 2, with an end of the film withdrawn therefrom, is stored in the storage portion 21 after the container 11 is opened along the hinge 22.

Thereafter, the film 1 is withdrawn and fitted in the guide portions 15*a* whereupon the container 11 is closed. As a result, the opposite sides of the film 1 are positioned by the slits constituted by the step portions 13*a* and 15*a* as shown in FIG. 1, so that the film 1 can be withdrawn in a direction of the arrow X shown in FIG. 3. The forward end of the film 1 is generally uneven having a tongue portion extending therefrom. Before or after the film is loaded in the container 11, the forward end of the film 1 is cut straight across as shown in the FIG. 1.

Although the cartridge 2 is generally shaped substantially like a cylinder, it is noted that the outer surface of the film draw-out portion 2*a* of the cartridge is substantially planar. Correspondingly, a partial wall 21*a* of the storage portion 21 adjacent the film draw-out portion 2*a* of the cartridge is also partially shaped in a planar manner as shown in FIG. 3, and extends to the slits. That is, the partial wall 21*a* extends to the film leading-out portion for withdrawing the film 1.

When the cartridge 2 is to be stored in the storage portion 21, the film draw-out portion 2*a* is positioned adjacent the planar partial wall 21*a* of the storage portion 21 so that the film 1 can be pulled therealong through the slits in a straight manner. As a result, the cartridge 2 is held and the curling of the film 1 is corrected. Further, the cartridge 2 in the storage portion 21 is prevented from rotating, so that the film 1 can be pulled out smoothly and can be supplied automatically with ease.

The automatic developing apparatus using the aforementioned container 11 will be described hereunder.

FIG. 4 is a typical structural diagram of an automatic loader, FIG. 5 is a cross sectional view of important part of the holder having a function of guiding the container, and FIG. 6 is a diagram of the automatic developing apparatus.

The automatic loader 31, includes a holder 32 for holding containers 11 arrange one adjacent and above another, a feed-out control mechanism 33 for individually supplying the containers to the automatic developing apparatus 100 (which will be described later) a preferential treatment gate 34 for preferentially subjecting a desired container 11 to development, a shutter mechanism 35 for preventing light from entering the inside of the automatic developing apparatus 100 and for successively feeding the containers 11 to the automatic developing apparatus 100, a mechanism 36 for withdrawing the film 1, a mechanism 37 for cutting the film 1, carrier rollers 38 for supplying the film 1 to a developing tank (which will be described later) or the like, a withdrawal mechanism 39 for withdrawing the cartridges 11 after the withdrawal of the film 1, and a withdrawal pocket portion 40.

As shown in FIG. 5, the cross-sectional shape of the holder 32 substantially corresponds to the external shape of the container 11. That is, two guide grooves 41 are formed in the upper wall to receive the guide projections 16 of the container 11. Further, the holder 32 is formed cylindrically so that a desired number of containers 11 can be retained and slid down while guided by the guide grooves 41. The holder 32 is obliquely attached to a housing 101 of the automatic development apparatus 100 in the manner illustrated in FIG. 4.

When a container 11 is to be inserted into the holder 32, the container 11 is inserted such that the guide projections 16 are guided by the two guide grooves 41 with the front face of the container 11 facing forward, that is, with the draw-out direction of the film 1 facing diagonally downwardly in FIG. 4. The guide grooves 41 are formed so as to be biased to one side to prevent mistaken insertion of the container 11. Accordingly, when the container 11 is accidentally attempted to be inserted in an inverted manner, the guide projections 16 cannot be fitted into the guide grooves 41 so as to prevent the erroneous insertion.

The feed-out control mechanism 33 is provided to successively and individually supply a plurality of containers 11 to a standby position between the feed-out control mechanism 33 and the .shutter mechanism 35 to avoid simultaneously supplying the containers 11 to the automatic developing apparatus 100. The stopper 33 can be driven using a plunger-and-solenoid arrangement, or the like.

The preferential treatment gate 34 is formed so as to be able to be opened and closed as shown in FIG. 4, in which a part of the holder 32 is shown by the dotted line. When there is any film to be subjected to a developing treatment prior to the container being inserted into the holder 32, the preferential treatment gate 34 is opened so that the container to be preferentially treated can be inserted between the feed-out control mechanism 33 and the shutter mechanism 35.

As noted above, the shutter mechanism 35 prevents light from entering into the automatic developing apparatus 100 and feeds the container 11, disengaged by the feed-out control mechanism 33, into the automatic developing apparatus 100. The shutter mechanism 35 is normally shut but is controlled to be opened in order to feed the container 11 to the automatic developing apparatus 100. Specifically, when the shutter mechanism 35 is opened, the container 11 is slid from the standby position down along a carrier path 42 and positioned in a film draw-out position.

The film draw-out mechanism 36 comprises a draw-out roller 44 and a nip roller 43 which are respectively located in lower and upper positions to nip the film 1 therebetween to thereby withdraw the film 1. The draw-out roller 44 is driven to rotate in the direction of the arrow shown in FIG. 4 by a driving mechanism 46 constituted by an electric motor, or the like. The axial length of the pair of rollers 43 and 44 is set so that the rollers can be fitted into cavity portions formed by the pair of guide portions 13 and 15 provided in the container 11.

When the container 11 is properly positioned and the film 1 is withdrawn to end of the pair of guide portions 13 and 15, the end portion of the film 1 is not curled, but rather is flat. Accordingly, the film 1 can be easily nipped by the pair of rollers 43 and 44. Further, the film 1 can be pulled straight by rotating the rollers 43 and 44. Further, because the end portion of the film 1 is not curled, the container 11 can be automatically conveyed down the holder 32 without film interference. The film 1 thus pulled out is carried by the carrier rollers 38 through a guide portion 47 and supplied to a developing tank or the like.

The withdrawal mechanism 39 is arranged so that a part 45 of the bottom of the carrier path 42 can be opened, as shown by the dotted line, to withdraw the container 11 after the film 1 has been completely withdrawn. The opening and shutting of the bottom part 45 is driven by a driving mechanism including a plunger-and-solenoid 46. When the bottom part 45, constituting the withdrawal mechanism 39, is opened the container 11 drops down to the pocket portion 40 so that the container 11 can be removed from the housing from the outside.

Figure 11:
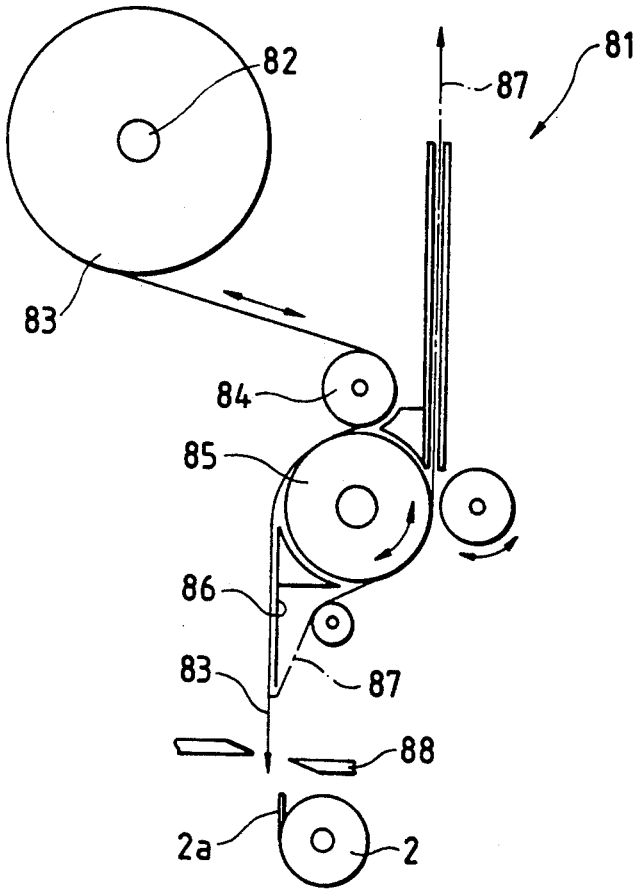
FIG. 11 is a typical constituent view showing the configuration of the film end treatment device according to the present invention.

Referring briefly to FIG. 11, a tongue draw-out device 81 for withdrawing the end portion of the film from the cartridge 2 is provided in the vicinity of the holder 32 in the automatic loader 31. In most cases, the film 1 is rolled so as to be entirely contained in the cartridge 2. Therefore, the end of the film 1 must be withdrawn from the cartridge 2 before the holder is loaded with the cartridge 2. For example, FAE500 made by Fuji Photo Film Co., Ltd. may be used as the tongue draw-out device 81 which will be described in greater detail below.

The treatment of developing the film 1 supplied by the carrier rollers 38 will be described hereunder with reference to FIG. 6. In the housing 101, a developing tank 105, a bleaching tank 106, a fixing tank 107, three washing tanks 108 and a dryer portion 109 are arranged in the stated order from left to right in FIG. 6. Carrier rollers, as shown only in the developing tank 105, are provided in the respective tanks from the developing tank 105 to the washing tanks 108. The aforementioned automatic loader 31 is provided in the upper left portion of the housing 101.

The film 1 thus withdrawn is submerged in a developing solution while carried by carrier rollers 111 and inversion rollers 112 provided in the developing tank 105. The film 1 is then carried to the bleaching tank 106 by carrier rollers (not shown) and inversion rollers 112 and submerged therein. Thereafter, the film 1 is passed though the fixing tank 107 and submerged in a fixing solution and is then carried into the washing tanks 108. After being washed in the three successive washing tanks 108, the film 1 is carried into the dryer portion 109.

Thus, the film 1 is successively submerged in the treatment solutions in the respective tanks. The path for carrying the film 1 is formed like a slit, so that the film 1 is carried through the slit by carrier rollers 111 and inversion rollers 112. The dryer portion 109 blows hot air on the filter, as shown by the arrows in the carrier path of the film 1. The film 1 dried by the hot air may be ejected from the automatic developing apparatus or may be supplied to a printing apparatus (not shown).

As described above, the film 1 withdrawn from the container 11 is carried into the respective tanks successively. When a predetermined series of treatments of the film 1 in one container 11 have finished, the automatic loader 31 operates as described above to automatically supply the film 1 to the next container 11. Accordingly, automatic supply can be made without any structure of attaching a leader tape to the film 1. Consequently, developing work can be simplified.

Although the aforementioned embodiment relates to an automatic developing apparatus in which automatic loading can be performed by using the container 11, it is understood that automatic loading and automatic developing of the film 1 can be performed without the use of the container 11. An example of the automatic developing apparatus in which automatic loading can be made without using the container 11 will be described hereunder as a second embodiment of the present invention.

Figure 7:
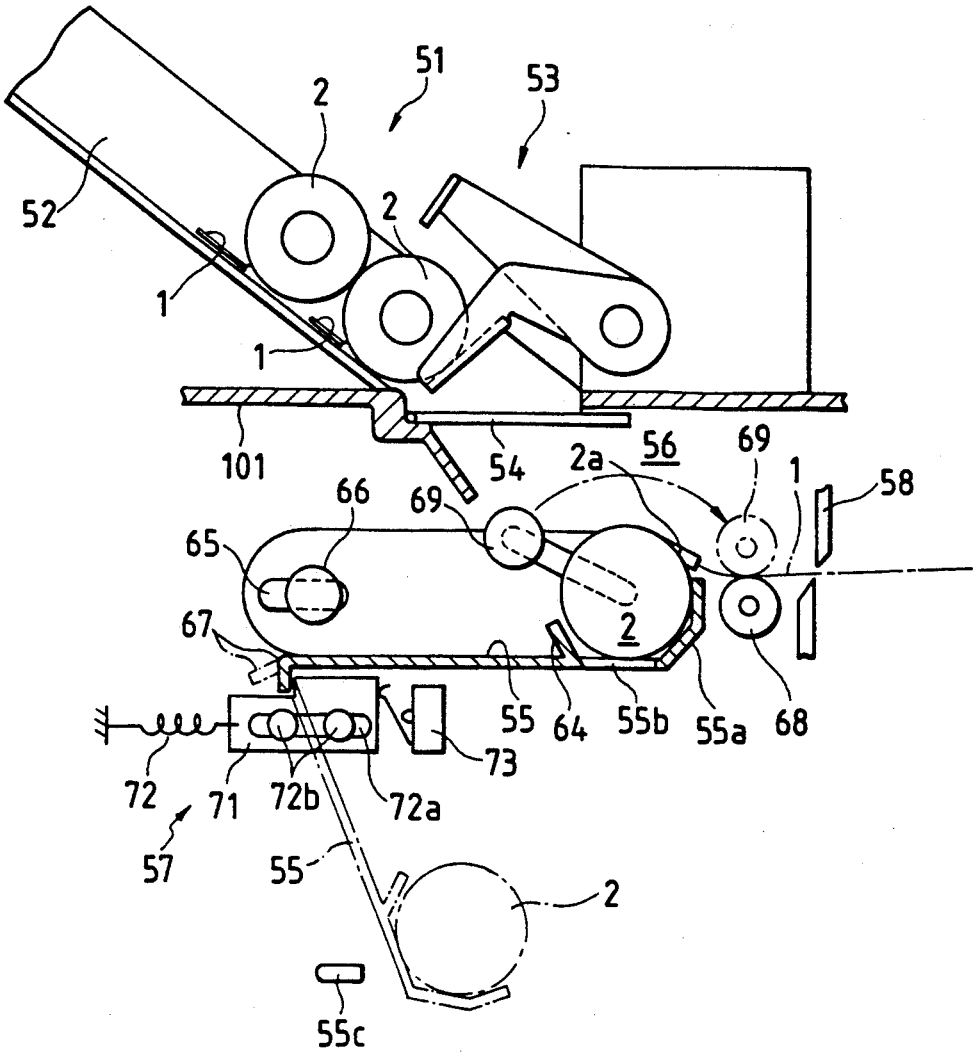
FIG. 7 is a configuration view showing a second example of an automatic loader.
Figure 8:
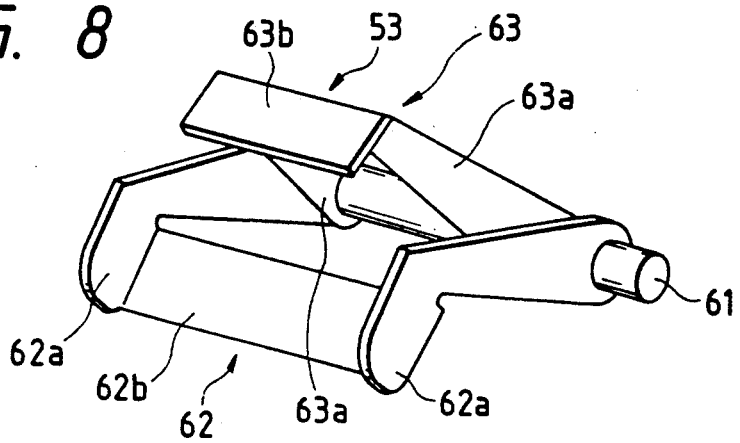
FIG. 8 is a perspective view of the feed-out mechanism according to the present invention.
Figure 9A:
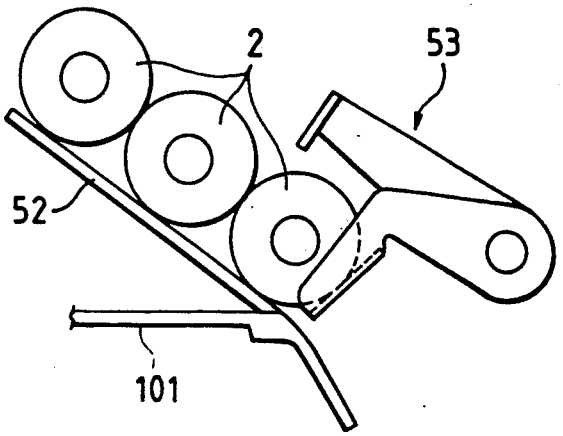
FIGS. 9(*a*), 9(*b*) and 9(*c*) are side views showing the operation of the feed-out mechanism.
Figure 9B:
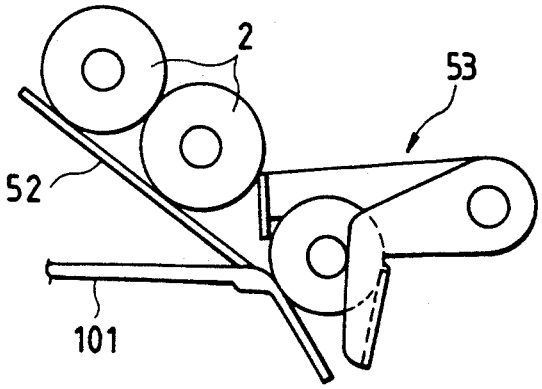
Figure 9C:
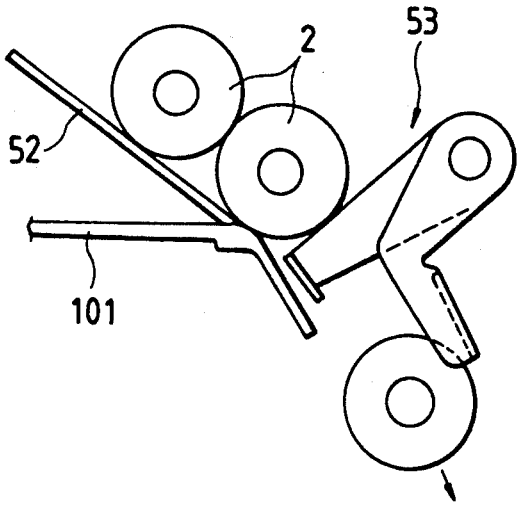
Figure 10:
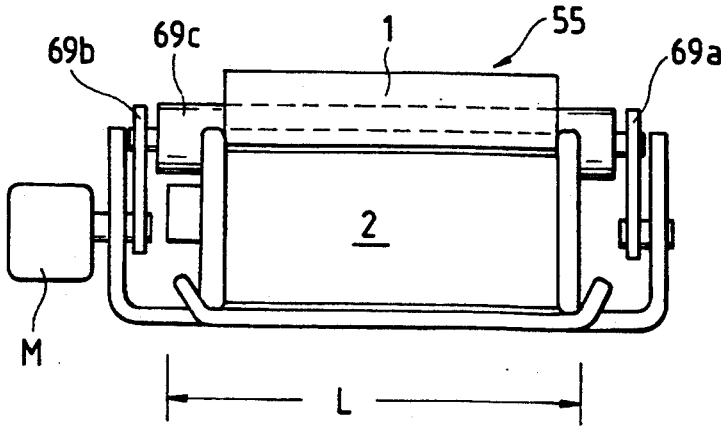
FIG. 10 is a side view showing the structure of the supply supporting portion according to the present invention.

FIG. 7 is a structural view of the automatic loader 51, FIG. 8 is a perspective view showing the structure of the feed-out mechanism 53, FIGS. 9(*a*), 9(*b*) and 9(*c*) are side views showing the operation of the feed-out mechanism 53, and FIG. 10 is a side view showing the structure of the mechanism 56 for withdrawing the film 1 rolled in the holder 52. In the description of this embodiment, parts which are the same as those discussed in regard to the first embodiment are identified by like numerals.

First, the configuration of the automatic loader 51 will be described. The automatic loader 51 comprises a diagonally disposed slide-like holder 52 having an opened upper surface, a feed-out mechanism 53 for successively and individually withdrawing the cartridges from the holder and feeding them to the automatic developing apparatus 100, a shutter mechanism 54 for preventing light from entering into the apparatus 100 after the completion of the feed-out operation, a supply supporting portion 55 for supporting the fed-out cartridge 2 to a position for withdrawing the film 1 from the cartridge 2, a draw-out portion 56 for withdrawing the film 1 from the cartridge 2, and an ejecting mechanism 57 for ejecting the cartridge 2 on the basis of the detection of the end of the film 1.

The holder 52 is obliquely attached to the apparatus 100 in the same manner as the holder 32 described above in the previous embodiment. The shape of the holder 52 is, however, simplified greatly as compared to the shape of the holder 32. That is, the holder 52 has a shape formed by removing the upper side of an elongate box. In other words, the holder 52 is shaped like a U-shaped slide. The inner lateral width of the holder 52 is slightly larger than the length of the cartridge 2. Further, the length of the holder 52 is suitably set to correspond to the number of cartridges to be arranged thereon.

The cartridges 2 are arranged in the holder 52 so that the film draw-out portion 2*a* is located on the lower side and the end portion of the film 1 is oriented upwardly along the bottom portion of the holder 1 as shown in FIG. 7. Accordingly, after a single or plurality of cartridges 2 are arranged, the cartridge 2 can slide down by their own weight toward the apparatus 100.

As shown in FIG. 8, the feed-out mechanism 53 comprises a first supporting member 62 and a second supporting member 63 which serve as a unitary structure which is rotatable a predetermined angle on a rotation shaft 61. The first supporting member 62 is comprised of a pair of L-shaped turning members 62*a* each having an end fixed to the rotation shaft 61, and a supporting plate 62*b* extending between the respective forward ends of the turning members 62*a*. The length of each of the turning members 62*a* is set to correspond to the position where the rotation shaft 61 is attached and the position where a cartridge 2 is supported in a standby position.

The rotation shaft 61 is attached at a predetermined position on the apparatus 100 so that it can be freely reciprocatingly rotated by a driving means such as a motor (not shown). The supporting plate 62*b* is fixed to the lower side of the pair of turning members 62*a* so that a U-shaped frame is constituted by the supporting plate 62*b* and the front end portions of the pair of turning members 62*a*. When a cartridge 2 is supported as shown in FIG. 7, the cylindrical portion and opposite side portions of the cartridge 2 are each supported by the U-shaped frame.

The second supporting member (stopper) 63 is comprised of a pair of turning members 63*a* each having an end fixed to the rotation shaft 61, and a fixed supporting plate 63b extended between the forward ends of the turning members 63*a*. The supporting plates 62*b* and 63*b* are each rotatable in the same direction at a predetermined distance. The function of the second supporting member 63 will be described later in conjunction with the feed-out of the cartridge 2.

The shutter mechanism 54 is arranged so that it is open when the cartridge 2 is fed to the apparatus 100, and is closed at all other times. The opening and shutting operation is carried out in correspondence with the control of the feed-out mechanism 53. The supply supporting portion 55 includes a U-shaped portion to support the cartridge 2 fed-out from the holder 52. Specifically, at one end of the supply supporting portion 55, a supporting piece 64 is formed to be fitted to the cylindrical portion of the cartridge 2 so that the cartridge 2 can be positioned rotatably.

At the other end of the supply supporting portion 55 (i.e, the left side in FIG. 7) a long guide hole 65 and a supporting shaft 66 are provided for supporting the cartridge so as to be slightly movable in the left and the right in the drawing and rotatable as shown in the dotted line. In the lower portion thereof, a stoppage projection 67 is provided to rotate the supply supporting portion 55 from the position illustrated by the solid line to the position illustrated by the dotted line in correspondence with the operation of the ejecting mechanism 57. The stoppage projection 67 is engaged with one end of the ejecting mechanism 57 (which will be described later).

The film draw-out mechanism 56 comprises a sprocket 68 and a nip roller 69 provided on the right side as illustrated in FIG. 7. The structure of the film draw-out mechanism 56 can be understood easily by referring to FIGS. 7 and 10. The sprocket 68 is rotatably attached to the apparatus 100 and has projections (not shown) formed in its opposite side portions which are engageable with perforations (film feed holes) 1*a* formed in opposite side portions of the film 1. The nip roller 69 includes a turning member 69*a* rotatably attached to one end of the supply supporting portion 55 so at to be pivotable coaxially with the cartridge, a turning member 69*b* rotatable by a motor M, and a roller 69*c* rotatably secured to the forward ends of the turning members 69*a* and 69*b*.

In a standby state before the developing of the film 1 (i.e., in a state before the cartridge 2 is supplied to the supply supporting portion 55), the nip roller 69 is positioned at the position shown in the solid line in FIG. 7. When, in this state, the cartridge 2 is supplied onto the supply supporting portion 55, the film draw-out portion 2*a* faces upwardly because cartridges on the holder 52 are piled up so that the forward end of the film 1 is turned upward. As a result, the forward end portion of the film 1 drawn out from the film draw-out portion 2*a* is positioned within the range of pivot movement of the roller 69*c*. As viewed from the side of the film draw-out mechanism 56 (i.e., the left in FIG. 7), the roller 69*c* is behind the film 1 as shown in FIG. 10. When, in this state, the roller 69*c* or the nip roller 69 is pivoted from the position of the solid line to the position of the dotted line, the forward end of the film 1 is urged in the clockwise direction in FIG. 7 by the roller 69*c*. As a result, the forward end portion of the film 1 is pressed against the sprocket 68. Accordingly, the film 1 is drawn out of the cartridge 2 by turning the sprocket 68.

Since the cartridge 2 merely rests on the supply supporting portion 55 and is not fixed thereto, when the film 1 is withdrawn the cartridge 2 as a whole is pulled laterally as well. However, the vertical wall portion 55*a*, formed at the right end of the supply supporting portion 55, acts as a stop for preventing lateral movement of the cartridge.

The ejecting mechanism 57 comprises a moving member 71 provided so as to be movable in the left and right directions, a tension spring 72 for urging the moving member 71 to the left, and a switch 73 for detecting the position of the supply supporting portion 55. An elongate guide hole 72*a* extending left to right in the drawings is formed in the moving member 71. Two guide pins 72*b* are inserted into the guide hole 72*a* at predetermined positions so that the moving member 71 is restricted to move in the left and right directions.

The stoppage projection 67 formed in the lower portion of the supply supporting portion 55 is engaged with one end of the moving member 71. While the film 1 is withdrawn, the entire supply supporting portion 55 is pulled to the right in FIG. 7 by the cartridge 2. In this state, however, the tension spring 72 prevents the moving member 71 from moving a sufficient distance to push switch 73. As a result, the supply supporting portion 55 is maintained in the state shown in the solid line in FIG. 7, so that withdrawal of the film 1 is continued.

A series of operations from the feed-out of the cartridge 2 to the ejection thereof in the automatic loader 51 will be described hereunder. Before a developing treatment starts, the feed-out mechanism 53 is positioned as shown in FIGS. 7 and 9(*a*) so that the lower most end of the holder 52 is blocked by the first supporting member 62 (FIG. 8). A desired number of cartridges 2 are supported by the first supporting member 62 so that they are prevented from sliding down. As a result, the cartridges 2 are aligned along the inclination of the holder 52 in an oblique manner. The cartridges 2 are arranged such that the film draw-out portion 2*a* faces downwardly and the forward end of the film 1 faces upwardly. The cartridges are easily arranged in this position due to the manner in which the holder 52 is opened at its upper portion.

After the cartridges 2 have been arranged, the feed-out mechanism 53 is driven in the counterclockwise direction by starting the apparatus 100. As a result, the lower most cartridge 2 supported by the first supporting member 62 begins to slide down in correspondence to the movement of the first supporting member 62 as shown in FIG. 9(*b*). At the same time, the stopper 63 is urged between the lowermost cartridge 2 and the next upper cartridge 2 to prevent the upper cartridge 2 from sliding down. Because the width of the stopper 63 is smaller than the width of the first supporting member 62 as shown in FIG. 8, the cylindrical portion of the upper cartridge 2 is supported to prevent the upper cartridge 2 from sliding down.

When the downward movement of the cartridge 2 is started by the operation of the feed-out mechanism 53, the shutter mechanism 54 is driven synchronously so that a carrier path for sliding down the cartridge 2 is temporarily formed between the holder 52 and the supply supporting portion 55. Accordingly, the lowermost cartridge 2 is fed out so as to slide down onto the supply supporting portion 55 without colliding with the shutter mechanism 54.

In this case, the forward end of the film 1 protrudes from the draw-out portion 2*a*. However, since a picture is not exposed on this portion of the film there are no adverse effects to the film. Further, while the lowermost cartridge 2 is fed out, the next upper cartridge 2 is supported by the stopper 63 as shown in FIG. 9(*c*). Accordingly, simultaneous sliding-down of two cartridges 2 can be prevented, so that cartridges 2 can be individually and successively fed to the apparatus 100 steadily.

When the feed-out of the lowermost cartridge 2 is finished, the feed-out mechanism 53 is rotated in the clockwise direction so that the next cartridge 2, as new lowermost one, is supported by the supporting member 62. The operation is explained as follows by reference to FIGS. 9(*a*) through 9(*c*). The position of the feed-out mechanism is successively changed from the state of FIG. 9(*c*) to the state of FIG. 9(*b*) and, thereafter to the state of FIG. 9(*a*). Each time the feed-out mechanism 53 returns to the position illustrated in FIG. 9(*a*), the number of the cartridges 2 is decreased by one.

After a single cartridge has been fed as described above, the shutter mechanism 54 returns correspondingly to cover the lower opening of the feed-out mechanism 53. As a result, the lower portion of the holder 52 is perfectly shaded, so that light is prevented from entering into the apparatus 100. Accordingly, even in the case where the film 1 is withdrawn from the cartridge 2, the film 1 is free from exposure.

The operation of withdrawing the film 1 will be described hereunder. In the condition that the cartridge 2 is fed out onto the supply supporting portion 55 and positioned, the roller 69*c* constituting the film draw-out mechanism 56 is positioned to a position shown in the solid line in FIG. 7 as described previously. The draw-out mechanism 56 is driven synchronously with the returning of the feed-out mechanism 53 and the shutter mechanism 54, so that the roller 69*c* is urged to pivot from the position of the solid line to the position of the dotted line. As a result, the forward end of the film 1 is urged so as to rotate in the clockwise direction by the roller 69*c* so as to strike against the sprocket 68.

The film 1 is continuously withdrawn from the draw-out portion 2*a* by the rotation of the sprocket 68, so that the film 1 is submerged in the developing tank 105 as described above with reference to FIG. 6. The treatment downstream of the developing tank has been described previously.

Since the film 1 is continuously pulled by the film draw-out mechanism 56 to the right in FIG. 7, the supply supporting portion 55 as a whole is pulled toward the draw-out mechanism 55, or to the right in FIG. 7, as well. Because, however, the stoppage projection 67 is engaged with one end of the moving member 71 and the moving member 71 is urged to the left by the action of the spring 72, the balance between the pulling force resulting from withdrawal of the film 1 and the pulling force resulting from the spring 72 prevents the supply supporting portion 55 from moving to the draw-out mechanism 56 side. Further, the moving member 71 is also kept in a balancing state, so that the moving member 71 does not move to the left. Accordingly, the switch 72 provided in the vicinity of the moving member 71 remains in an off state.

When, to the contrary, the operation of withdrawing the film 1 is finished, the core of the film is securely pulled since the film 1 cannot be further withdrawn. As a result, the cartridge 2 and, attendantly the supply supporting portion 55 and the moving member 71, are pulled to the right in FIG. 7 against the force of the spring to thereby push the switch 73 on.

When the switch 73 is turned on, the cutter 58 is driven by a control circuit (not shown) to perform cutting of the film 1. At the same time, the nip roller 69 is turned in the counterclockwise direction to release the nipping of the forward end of the film 1 between the nip roller 69 and the sprocket 68. Further, a motor is operated to rotate the supply supporting portion 55 about the fulcrum pin 66 in the direction of clockwise rotation.

As a result, the cartridge 2 is moved away from the draw-out mechanism 56 and, furthermore, the supply supporting portion 55 is rotated clockwise. Accordingly, the two are turned as one body from the position of the solid line to the position of the dotted line in FIG. 7.

Thereafter, the cartridge 2 is separated from the supply supporting portion 55 and ejected. The ejecting operation can be carried out by the following structure.

That is, at the point of time when the supply supporting portion 55 is turned in the direction of clockwise rotation, the sprocket 2 is in a state where it is merely put on the supply supporting portion 55. Accordingly, if the supply supporting portion 55 is further turned from the position of the dotted line, for example, to form an angle of not smaller than 90°, the cartridge 2 is dropped from the supply supporting portion 55 to the withdrawal pocket portion 40 due its own weight.

Because the cartridge 2 is, however, positioned by the vertical wall portion 55*a* and the supporting piece 64, it may be difficult for the cartridge 2 to drop. Further, a large space is required for rotating the supply supporting portion 55 by an angle of greater than 90°.

Therefore, an insertion hole 55*b* is formed in the lower portion of the supply supporting portion 55 adjacent the cartridge and a projection 55*c* is provided on the locus of rotation of the insertion hole 55*b* for forcing the cartridge from the supporting portion. Specifically, the projection 55*c* is inserted into the insertion hole 55*b* when the supply supporting portion 55 is further turned from the position of the dotted line, so that the cartridge 2 can be forced out by the forward end thereof. Accordingly, ejection can be performed more readily.

On the other hand, when the supply supporting portion 55 is turned, the stoppage projection 67 is also turned. Accordingly, the force of temporarily pressing the moving portion 71 to the right is released, so that the moving member 71 is moved to the left due to the tension of the spring 72 and through the guide function of the guide hole 72*a* and the guide pins 72*b*. Accordingly, the switch 73 is turned off to operate the control circuit to thereby return the supply supporting portion 55 from the position of the dotted line to the position of the solid line.

As a result, the stoppage projection 67 is engaged with one end of the moving member 71 again to press the moving member 71 to the right against the spring 72. At this point, the automatic loader is returned to its initial state, that is, the standby state to prepare for the feed-out of the next cartridge 2.

In the case where a film 1 is to be preferentially treated in the period in which the automatic loading of the cartridge 2 is carried out as described above, preferential treatment can be made very easily. That is, in this embodiment, the holder 52 is open at its upper portion. Accordingly, in the case where a certain film 1 is to be treated preferentially, a number, N, of cartridges 2 piled up in the holder 52 are removed with one's hand through the opening of the holder and the cartridge 2 of the film 1 to be preferentially treated is set to the lowermost position. Removal of the cartridges can be accomplished by sliding the N cartridges 2 up along the holder 1 and then placing the cartridge 2 to be preferentially treated into the lowermost position, since the upper portion of the holder 1 is opened entirely.

Although this embodiment includes the sprocket 68 for use in the film draw-out mechanism 56, it is to be understood that the present invention is not limited thereto and that the sprocket 68 may be replaced by a nip roller, a teeth-containing belt, a chain or the like. Further, it is a matter of course that the driving source for the nip roller 69 and the supply supporting portion 55 is not limited to the motor and that the motor may be replaced by a plunger, a solenoid or the like.

The automatic loading is based on the assumption that the film protrudes from the end of the cartridge 2. The film 1, however, may be entirely contained in the cartridge 2 so that the forward end portion of the film 1 cannot be observed from the outside of the cartridge 2. In such case, the film 1 is drawn out by using the following film end treater and then the cartridge is set in the holder 52.

The film end treater (tongue draw-out device) will be described hereunder with reference to FIG. 11. FIG. 11 is a typical structural view of the tongue draw-out device 81 for withdrawing the film 1 from the cartridge 2. The tongue draw-out device 81 is provided in the vicinity of the automatic loader 51 so that the cartridge 2 can be loaded in the automatic loader 51 soon after the tongue is withdrawn.

An adhesive tape 83 with release paper is rolled on a take-up roll 82. The tape 83 with released paper is carried to a push plate 86 through a nip roller 84 by a feed roller 85. The released paper 87 is removed at the forward end of the push plate 86 while the adhesive tape 83 continues to be conveyed along a the push plate 86. The adhesive tape 83 can be reciprocated by the feed roller 85. The push plate 86 is loaded so as to enter into the outlet 2*a* of the cartridge 2 whereupon the loading of the push plate 86 is automatically detected to start the tongue draw-out operation. At this time, the feed roller 85 is rotated to continuously feed the adhesive tape 83 into and out of the cartridge 2. In most cases, the tongue portion of the film is withdrawn from the cartridge 2.

In this condition, the adhesive tape 83 adheres to the forward end of the tongue portion. Accordingly, it is necessary to cut the adhesive tape. Therefore, a cutter 88 is arranged in the vicinity of the push plate 86, so that the adhesive tape 83 can be cut by the cutter 88.

Although the tongue portion has been withdrawn from the cartridge, the film 1 cannot yet be loaded. Rather, it is first necessary to cut the tongue portion from the film to make the end edge of the film 1 linear and parallel to the widthwise direction of the film.

The condition that the forward end edge is linear may be insufficient. For example, the film length from the cartridge 2 is limited to an allowed range (for example, about 10 mm to about 30 mm) in order to turn the cartridge 2 using the turning mechanism so as to move the forward end portion of the film 1 to a position where it can be nipped by the sprocket 68. If the length of the film extending from the cartridge 2 is outside of this range, proper operation may not be possible.

Therefore, it is preferable that the cutter 88 operate to cut a predetermined length portion of the film 1 withdrawn from the cartridge 2. For example, a portion for limiting the position of the cartridge 2 may be provided below the cutter 88 in the drawing so that the film 1 can be cut in the condition that the motion of the cartridge 2 is limited. If the distance between the portion for limiting the position of the cartridge 2 and the cutter 88 is set to a suitable value, the film 1 can be cut so that the film 1 is drawn out by a predetermined length from the cartridge 2. The tongue draw-out work can be continued by cutting the adhesive tape 83 adhered to the tongue portion through the cutter 88 after cutting the film.

Although the above embodiment has been described with a cutter as part of the apparatus, it is of course understood that a cutter having the aforementioned function may be provided separately.

Figure 12:
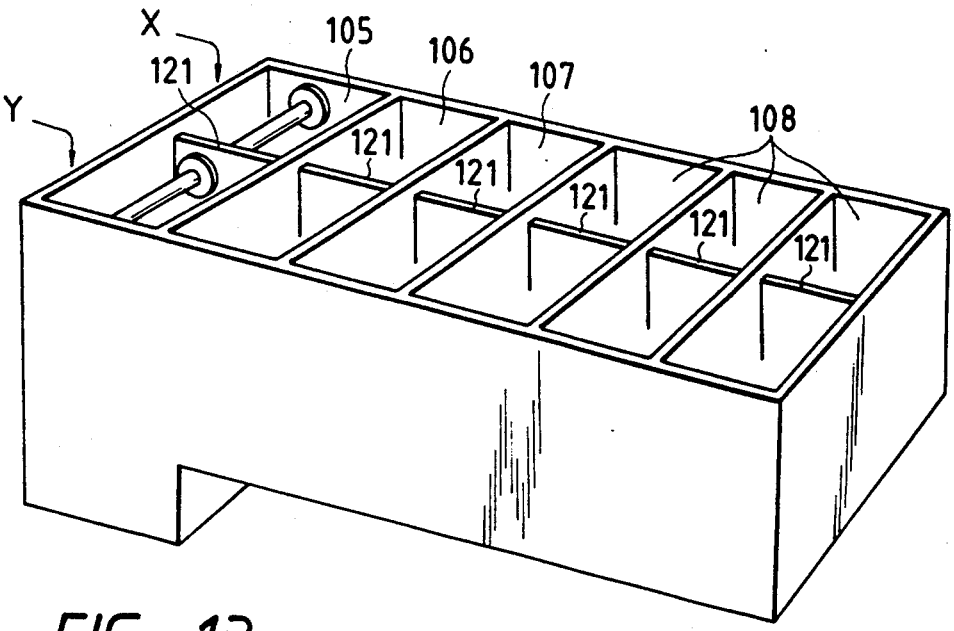
FIG. 12 is a perspective view illustrating an example of the configuration of the treatment tanks.
Figure 13:
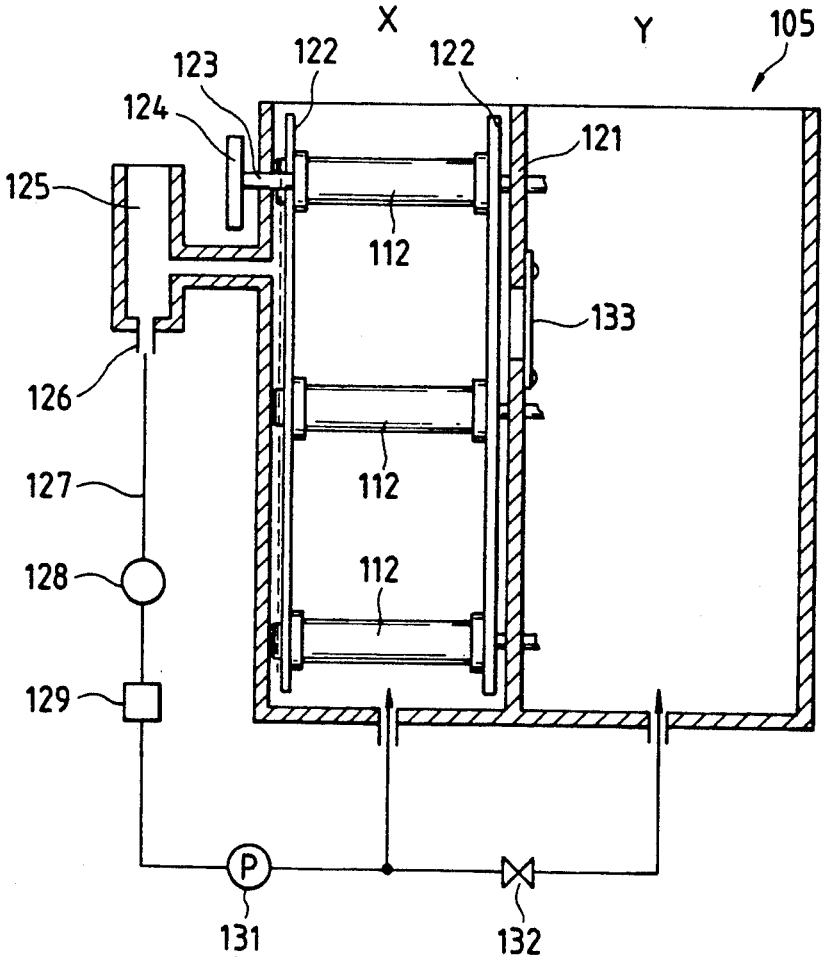
FIG. 13 is a vertical sectional view showing the configuration of the treatment tanks illustrated in FIG. 12.

Another example of the automatic developing apparatus will be described hereunder with reference to FIGS. 12 through 14. This embodiment relates to treatment tanks in the automatic developing apparatus. The same parts as the parts in FIG. 6 are identified by like numerals.

A developing tank 105, a bleaching tank 106, a fixing tank 107 and three washing tank 108 are separated into a treatment system X for treating a leader-less film and a treatment system Y for treating a leader-containing film by a partition plate 121. In FIG. 12, carrier rollers 111 and 112 and the like are not shown for convenience of illustration. Though not shown, the film is carried to the developing tank 105 in the same manner as described above with reference to FIG. 6.

Although examples of the partition structure will be described hereunder, description will be limited to the partition structure of the developing tank 105, it being understood that the structure is the same for each tank.

A first example of the partition structure will be described first with reference to FIG. 13.

The developing tank 105 is partitioned by the partition plate 121 so that the width of the treatment system X is smaller than the width of the treatment system Y. This is caused by the fact that the width of the leader is larger than the width of the film and, accordingly, the leader-less film treatment system X is set to be adjusted to the width of the film whereas the leader- containing film treatment system Y requires a sufficient width to accommodate the leader.

Each of the carrier racks is constituted by a carrier roller 112 and a pair of side plates 122 typically shown. The carrier roller 112 is attached to the pair of side plates 122 so as to be rotatable. For example, a rotating force is transmitted to the carrier roller 112 by a gear 124 mounted to a rotation shaft 123. Carrier racks are also provided in the treatment system Y. Because each of the carrier racks in the treatment system Y can be formed in the same manner as each of the carrier racks in the treatment system X, both illustration and description of the carrier racks in the treatment system Y are omitted.

A tank 125 for circulating the developing solution in the developing tank is provided in the left side of the developing tank 105, so that the developing solution overflowing from the developing tank can be reserved. A pipe 127 is connected to an outlet 126 formed in the lower end of the tank 125. A heater 128 for heating the developing solution and a thermometer 129 are provided in the pipe 127. The heater 128 is provided to heat the developing solution to a desired temperature to thereby improve the developing treatment rate, and the thermometer is provided to monitor the temperature of the developing solution.

A pump 131 is provided to circulate the developing solution to the treatment systems X and Y. A valve 132 is provided in the return current path to the treatment system Y. The valve 132 has the following function as related to a partition cover 133 provided on the partition plate 121.

That is, in the structure of the treatment tank according to this embodiment, the developing solution is supplied to the treatment systems X and Y and further circulated through an opening in the valve 132 and an opening in the partition cover 133 and pumped by the pump 131. Accordingly, the developing treatment of the leader-less film and the developing treatment of the leader-containing film can be carried out simultaneously by using the treatment systems X and Y.

There however may be a case where the developing treatment of the leader-less film is carried out alone. In this case, the valve 132 is shut and the partition cover 133 is shut. In this manner, the supply of the developing solution to the treatment system Y and the stopping thereof can be performed, so that the supply and return current of the developing solution to the treatment system X can be performed independently. Accordingly, though two treatment systems X and Y are provided, the developing treatment of the leader-less film can be carried out exclusively. The carrier rollers 112 in the treatment systems X and Y may be driven separately so that energy may be saved by stopping the driving of the carrier racks when the treatment system Y is not used.

Figure 14:
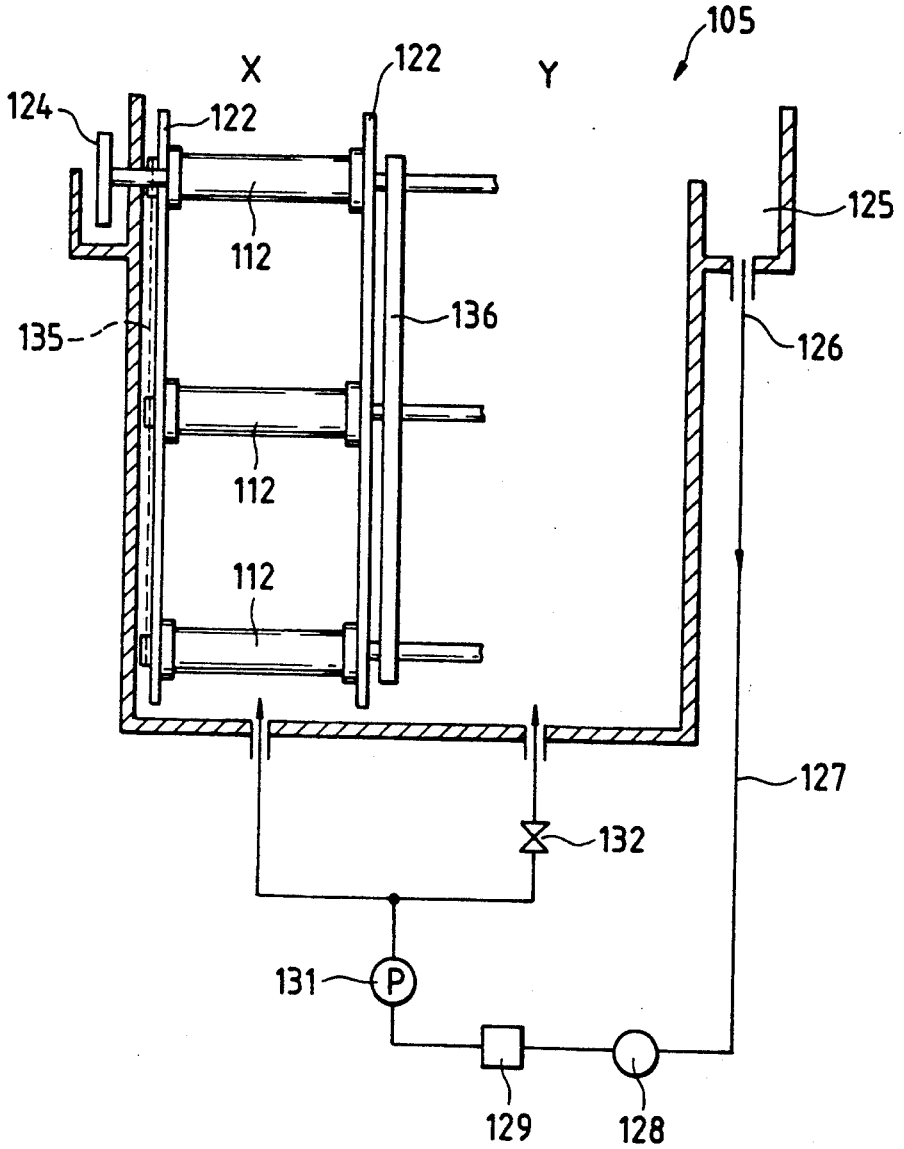
FIG. 14 is a vertical sectional view showing another example of the configuration of the treatment tanks.
Figure 15:
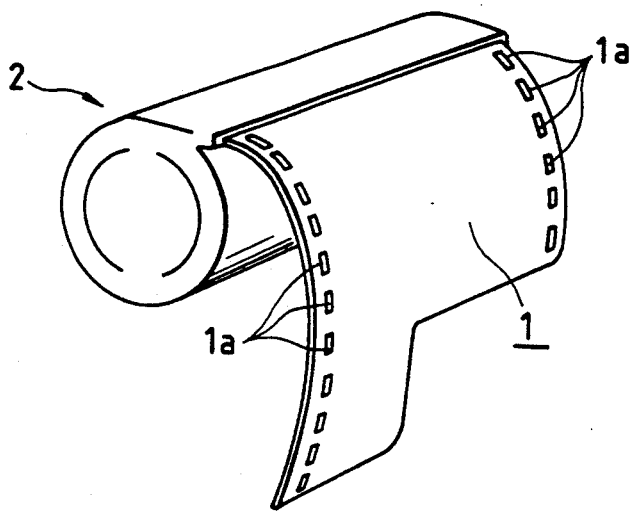
FIG. 15 is a perspective view showing the conventional arrangement where film is withdrawn from the film cartridge.
Figure 16:
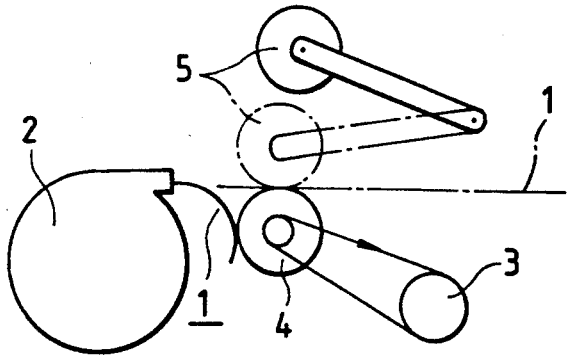
FIG. 16 is an explanatory view showing a conventional film conveying system.

As shown in FIG. 14, the partition plate 121 may be removed; the tank 125 may be provided in the treatment system Y side; and the inner side plates 122 may be used as the carrier racks in the treatment system Y. In this structure, the treatment tanks are commonly used in the treatment systems X and Y, portions of the carrier racks are common to both systems, and the carrier rollers are driven by a common driving source. Accordingly, not only can the structure be simplified, but the developing treatments in the treatment systems X and Y can be carried out. Furthermore, the developing treatment in either of the treatment systems can be performed exclusively.

Although it is preferable in the treatment system X that the film carrier path be shaped like a slit, the carrier rollers 112 may be driven by a chain 135. On the other hand, the treatment system Y may be formed so that the film is carried by a belt 136 having teeth thereon.

Further, the driving source for the carrier rollers 112 and the driving source for the belt 136 may be provided separately.

Two types of film treatments can be carried out simultaneously by providing the leader-less film treatment system X and the leader-containing film treatment system Y in parallel. The treatment system X has slit-shaped carrier paths and carrier means mainly adapted for the treatment of a 135-size film. The treatment system Y has the same carrier roller group as the conventional carrier, by which a 110-size film or a brownie size film as well as a 135-size film can be treated. Though the film to be treated is a 135-size film which can be originally treated in the treatment system X, the conveyance of the film in the treatment system X may be poor if perforations of the film are in poor condition or if the film is wet. In such case, the film can be treated by the treatment system Y. Accordingly, the problem in poor conveyance can be solved.

As described above, the film container according to the present invention can retain the film while remedying the curling of the film drawn out of the cartridge. Accordingly, the film can be supplied steadily and easily to the automatic developing apparatus.

Further, the automatic developing apparatus according to the present invention is formed so that not only a desired number of film containers can be held by a holder, but the film containers may be individually and successively conveyed and positioned to a film draw-out position to enable the film to be supplied to the developing tank and the like after withdrawing the film through the film draw-out mechanism while remedying the curling of the film. Accordingly, there is no failure caused by the curling of the film. As a result, automatic supply of the film can be made efficiently and exactly.

We claim:

1. An automatic developing apparatus for developing film wound within a cartridge which is stored in a container, comprising:

a holder for holding a plurality of containers therein;

feed-out control means for retaining said containers in said holder and for individually and successively feeding said containers from said holder to a film draw-out position;

a shutter disposed between said feed-out control means and said film draw-out position for preventing light from entering said film draw-out position, said shutter being openable to allow said containers to be fed to said film draw-out position;

draw-out means for withdrawing the film out of said container positioned in said film draw-out position; and ejecting means for ejecting said container from said draw-out position.

2. An automatic developing apparatus according to claim 1, wherein said holder includes aligning means to insure that said containers are inserted into said holder in a predetermined orientation.

3. An automatic developing apparatus according to claim 2, wherein said aligning means includes a pair of grooves provided along an inner periphery, of said holder which align with a pair of projections provided in said containers only when said containers are inserted in the proper orientation.

4. An automatic developing apparatus for developing film wound in a cartridge, comprising:

a holder for holding a plurality of said cartridges;

feed-out control means for individually and successively feeding out said cartridges to a film draw-out position;

positioning means for adjusting an angular position of said cartridge at said film draw-out position by rotating said cartridge;

a shutter disposed between said holder and said film draw-out position for preventing light from entering into said draw-out position, said shutter being openable to allow said cartridges to be fed from said holder to said film draw-out position; and ejecting means for ejecting said cartridge from said draw-out position.

5. An automatic developing apparatus according to claim 4, wherein said holder includes a slide-like ramp disposed in an oblique manner and wherein said feed-out control means comprises:

a first arm disposed in a first position at which said first arm supports a lowermost cartridge on said ramp;

means for rotating said first arm to a second position to allow said lowermost cartridge to be fed from said holder; and a second arm for preventing an adjacent second lowermost cartridge from being fed upon rotation of said first arm from said first position to said second position.

6. An automatic developing apparatus according to claim 5, wherein said second arm is coaxially disposed with respect to said first arm and rotatable by said rotating means.

7. An automatic developing apparatus of claim 4, wherein said holder includes a preferential treatment gate for guiding another cartridge not being held in said holder into said film draw-out position preferentially to said cartridges being held in said holder.

8. An automatic developing apparatus according to claim 4, further comprising a film end treatment device for withdrawing said film from said cartridge and for cutting said film at a predetermined length.

* * * * *